US006765167B2

(12) United States Patent
Kikuchi et al.

(10) Patent No.: US 6,765,167 B2
(45) Date of Patent: Jul. 20, 2004

(54) ELECTRIC CONTACT MEMBER AND PRODUCTION METHOD THEREOF

(75) Inventors: Shigeru Kikuchi, Tokai (JP); Masaya Takahashi, Hitachi (JP); Noboru Baba, Hitachiohta (JP); Masato Kobayashi, Hitachi (JP); Yoshitomo Goto, Hitachi (JP); Yasuaki Suzuki, Hitachi (JP); Takashi Sato, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/950,679

(22) Filed: Sep. 13, 2001

(65) Prior Publication Data

US 2003/0010752 A1 Jan. 16, 2003

(30) Foreign Application Priority Data

Apr. 13, 2001 (JP) ..... 2001-115083

(51) Int. Cl.[7] ..... H01H 33/66

(52) U.S. Cl. ..... 218/118; 218/123; 218/130

(58) Field of Search ..... 218/123–128, 218/118–120, 155, 115, 129–133

(56) References Cited

U.S. PATENT DOCUMENTS 6,248,969 B1 * 6/2001 Komuro et al. ..... 56/264

FOREIGN PATENT DOCUMENTS

| | | | | |
|---|---|---|---|---|
| EP | 0905726 A2 * | 3/1999 | ..... | H01H/33/66 |
| JP | 1167847 A * | 6/1999 | ..... | H01H/33/66 |
| JP | 2000-235825 | 8/2000 | | |

* cited by examiner

*Primary Examiner*—Lincoln Donovan
*Assistant Examiner*—M. Fishman
(74) *Attorney, Agent, or Firm*—Mattingly, Stanger & Malur, P.C.

(57) ABSTRACT

An electric contact member has a texture wherein fire proof metal powder having the form of a flat plate is diffused in a matrix of a highly conductive metal. The flat surface is oriented in one direction and the surface in parallel with the flat surface of the fire proof metal powder is used as a contact point face.

14 Claims, 5 Drawing Sheets

ELECTRIC CONTACT MEMBER AND PRODUCTION METHOD THEREOF

BACKGROUND OF OF THE INVENTION

1. Field of the Invention

The present invention relates to a new electric contact member used in a vacuum circuit breaker, vacuum switch or the like, a manufacturing method thereof, and a vacuum valve and vacuum circuit breaker made thereof.

2. Description of the Prior Art

The electrode in a vacuum valve installed in a vacuum circuit breaker or the like comprises a pair of electrodes on the fixed and movable sides. The electrodes on the fixed and movable sides consist of an electric contact and electrode rod connected thereto, and the back of the electric contact is often reinforced by a stainless steel plate.

Cr—Cu composite metal is often used to manufacture the electric contact member for large current and high voltage breaking.

The electric contact is manufactured by machining an electric contact material into a specified form, wherein the electric contact material is produced in the so-called method of powder metallurgy consisting of a first step of forming metal powder of various components or a mixture thereof into a simple structure (disk form, for example) at a specified composition and a second step of sintering it. The electric contact is provided with three or more slots for giving driving force to the produced arc so that arc will move to the circumference of the electrode without allowing arc to stay at one particular point, and these slots are formed in a vane-like separate shape. The center of the electric contact is provided with a concave to ensure that arc does not occur to remain at the center of the electric contact.

The above-mentioned electric contact is exposed directly to arc since it is used to turn on or off high voltage and current. The electric contact is required to provide a high breaking capacity, high dielectric strength and high welding resistance. It is difficult to meet all these requirements. In the products offered on the market, emphasis is generally placed on especially important characteristics according to a particular application at the sacrifice of other characteristics to some extent.

A large electric conductivity is essential to ensure large breaking capacity in the Cr—Cu composite metal, for example. This requirement can be met by the composition with an increased amount of Cu. However, this involves an decrease in the amount of Cr which increases dielectric strength, with the result that both dielectric strength and welding resistance are decreased.

Amid ever increasing amounts of voltage in power distribution business, a vacuum circuit breaker or vacuum switch is required to ensure compatibility of a large current breaking capacity with dielectric strength and welding resistance. For example, when the Cr—Cu composite metal is used to manufacture an electric contact, dielectric strength and welding resistance can be improved by increasing the amount of Cr. Increase in the amount of Cr, however, reduces conductivity and breaking capacity, making it difficult to ensure compatibility of a large current breaking capacity with dielectric strength and welding resistance in the prior art.

Japanese patent laid-Open publication NO. 235825/2000 discloses an electrode member with fire proof metal powder having the form of a flat plate. This is produced by spray-coating of the composite metal between highly conductive metal and fire proof metal onto the contact point face. Spray coating method, however, involves spray coating gas and atmosphere, so the obtained spray coated film contains a large amount of gas. Gas is discharged by arc heating at the time of current breaking, and arc is kept there through this gas, possibly causing current breaking to be disabled. Further, the size and form of fire proof metal powder on the spayed film is difficult to control, and tend to be irregular, with the result that breaking performances are unstable. In addition, formation of sprayed film requires much time, raising problems with productivity and costs.

SUMMARY OF THE INZENTION

The object of the present invention is to provide an electric contact member characterized by excellent current breaking capacity as well as a high degree of dielectric strength and welding resistance, and the method for manufacturing this electric contact member at a low production cost with high productivity.

In an effort to attain the above object, the inventors of the present application have invented a material texture which allows a large area to be occupied by the dielectric strength component on the contact point face where current breaking is performed. Namely, in the case of Cr—Cu electric contact, Cr particles are formed in a flat plate and the flat surfaces of Cr particles are oriented to be parallel to the contact point face in the Cu matrix. This structure allows many Cr particles to be exposed on the contact point face while reducing the amount of Cr and maintaining high conductivity, whereby high dielectric strength can be ensured. Further, the strength of the Cr particles perpendicular to the flat surface is reduced because of weak chemical bond between Cr particles and Cu matrix, and welding resistance is improved.

The following describes the summary of the present invention:

The electric contact member according to the present invention has a texture wherein fire proof metal powder having the form of a flat plate is diffused in the matrix comprising a highly conductive metal, and the electric contact member further characterized in that the flat surface of the fire proof metal powder is oriented in one direction and the surface in parallel with the flat surface of the fire proof metal powder is used as a contact point face.

The fire proof metal powder having the form of a flat plate according to the present invention is characterized in that the maximum length of the flat surface divided by the minimum dimension of the surface perpendicular thereto is within the range from 3 to 30.

The electric contact member according to the present invention is characterized in that 90 wt % or more of the fire proof metal powder having the form of a flat plate has the flat surface oriented with respect to the contact point face within the range from +40 to −40 degrees, and 75 wt % or more has the flat surface oriented with respect to the contact point face within the range from +20 to −20 degrees.

The above-mentioned fire proof metal powder according to the present invention comprises one of Cr, W, Mo, Ta, Nb, Be, Hf, Ir, Pt, Zr, Ti, Te, Si, Rh and Ru, a mixture comprising two or more of them or a compound thereof, and highly conductive metal comprises Cu, Ag, Au or an alloy mainly consisting of them.

The above-mentioned fire proof metal powder contains 50 to 2000 ppm of oxygen, 50 to 3000 ppm of aluminum and 100 to 2500 ppm of silicon.

The electric contact member according to the present invention comprises 15 to 40 wt % of the above-mentioned fire proof metal powder and 60 to 85 wt % of the conductive metal.

The electric contact member according to the present invention is characterized in that the percentage of the area occupied by the above-mentioned fire proof metal powder is 30 to 50% on the contact point face, and the percentage of the area occupied by the fire proof metal powder is 14 to 25% on the surface perpendicular to the contact point face.

The electric contact member according to the present invention contains 2500 ppm or less of oxygen, wherein the tensile strength in the direction perpendicular to the contact point face is 150 MPa or less, and the specific resistance is 5.5 $\mu\Omega$.cm or less.

The method for manufacturing an electric contact member according to the present invention characterized in that a powder mixture consisting of the above-mentioned fire proof metal powder and highly conductive metal powder is pressure-molded at a pressure of 120 to 500 MPa to create a molded product;

this molded product is sintered under vacuum or in inert atmosphere at the melting point equal to or less than that of said highly conductive metal powder; and a contact point face is created in parallel to the pressurized surface in the molding process.

The method for manufacturing an electric contact member according to the present invention characterized in that the obtained electric contact member is made compact by a pressure of 400 MPa or more applied in the same direction as that of the molding process.

The method for manufacturing an electric contact member according to the present invention is characterized in that a continuous plate- or rod-formed molded product is created by extrusion and compression molding of a powder mixture consisting of fire proof metal powder and highly conductive metal powder;

the molded product is sintered continuously under vacuum or in inert atmosphere at the melting point equal to or less than that of the highly conductive metal powder; and the surface parallel to the direction of extrusion is used as a contact point face.

The method for manufacturing an electric contact member according to the present invention is characterized in that the obtained electric contact member is further rolled, and the contact point face is created in parallel with the rolled surface;

wherein above-mentioned rolling is performed at the normal temperature or at the melting point equal to or less than that of the highly conductive metal.

The method for manufacturing an electric contact member according to the present invention is characterized in that a desired form is obtained by punching perpendicularly to the direction of extrusion.

The method for manufacturing an electric contact member according to the present invention is characterized in that the particle size of highly conductive metal powder does not exceed 80 $\mu$m.

The electric contact member according to the present invention is used as a member constituting a pair of electrodes on the fixed and movable sides in the vacuum valve, and this vacuum valve is used in the vacuum circuit breaker, vacuum switch and the like.

The vacuum valve according to the present invention is characterized in that the value y obtained by multiplying the rated voltage (kV) by breaking current effective value (kA) is within the range from the value obtained by the following equation (1) or less to the value obtained by the following equation (2) or more, based on the outer diameter x (mm) of the vacuum container:

$$y=11.25x-525 \quad (1)$$

$$y=5.35x-242 \quad (2)$$

The electric contact according to the present invention is characterized in that the diameter y (mm) is within the range from the value obtained by the following equation (3) or less to the value obtained by the following equation (4) or more, based on the value x (kVA$\times 10^3$) obtained by multiplying the rated voltage (kV) by breaking current effective value (kA):

$$y=0.15x+22 \quad (3)$$

$$y=0.077x+20 \quad (4)$$

The vacuum valve according to the present invention is characterized in that the diameter y (mm) of the vacuum container is within the range from the value obtained by the following equation (5) or less to the value obtained by the following equation (6) or more, based on the diameter x (mm) of the electric contact:

$$y=1.26x+30 \quad (5)$$

$$y=1.26x+10 \quad (6)$$

DESCRIPTION OF THE PREFERRED EMBODIMENTS

The texture of the electric contact member according to the present invention is characterized in that fire proof metal powder having the form of a flat plate is diffused in the matrix comprising a highly conductive metal, and the flat surface of said fire proof metal powder is oriented in one direction. When this electric contact member is used as an electrode, it is preferred that the surface in parallel with the flat surface of the fire proof metal powder be used as a contact point face. This structure allows many fire proof metal particles to be exposed on the contact point face while maintaining high conductivity without increasing the amount of contained fire proof metal whereby high dielectric strength can be ensured. Further, the strength in the direction perpendicular to the contact point face is small because of weak chemical bond between fire proof metal particles and highly conductive metal matrix. This makes it easy to separate and open the contact when the electrode is welded by arc heating, with the result that welding resistance is improved.

The above-mentioned fire proof metal powder having the form of a flat plate is preferred to be characterized in that the maximum length of the flat surface divided by the minimum dimension of the surface perpendicular thereto is within the range from 3 to 30. It ensures compatibility of large current breaking capacity with dielectric strength and welding resistance if 90 wt % or more of the fire proof metal powder contained in the electric contact member has the flat surface oriented with respect to the contact point face within the range from +40 to −40 degrees, and 75 wt % or more has the flat surface oriented with respect to the contact point face within the range from +20 to −20 degrees.

The fire proof metal powder constituting the electric contact material is preferred to comprise one of Cr, W, Mo, Ta, Nb, Be, Hf, Ir, Pt, Zr, Ti, Te, Si, Rh and Ru, a mixture comprising two or more of them or a compound thereof, and highly conductive metal is preferred to comprise Cu, Ag, Au or an alloy mainly consisting of them. An electric contact member featuring excellent current breaking capacity, a high degree of dielectric strength and sound material texture can be provided if the blending ratio between fire proof metal powder and highly conductive metal is such that 15 to 40 wt % of fire proof metal powder and 60 to 85 wt % of highly conductive metal are contained.

The fire proof metal powder is preferred to contain 50 to 2000 ppm of oxygen, 50 to 3000 ppm of aluminum and 100 to 2500 ppm of silicon. This provides an excellent arc extinguishing effect at the time of breaking, thereby improving the breaking performance. Aluminum and silicon can each occur as oxides, and excellent welding resistance and dielectric strength are ensured by uniform distribution of hard and fine aluminum and silicon oxides having a high melting point.

If the amounts of aluminum and silicon are smaller than the above, the amounts of generated aluminum and silicon will be smaller, giving a little effect in improving the performance. If the amounts are greater, much gas will be produced when oxides are decomposed by arc heating at the time of breaking, thereby reducing the high dielectric strength and breaking performance.

In the electric contact member according to the present invention, the percentage of the area occupied by the above-mentioned fire proof metal powder is preferred to be 30 to 50% on the contact point face, and 14 to 25% on the surface perpendicular to the contact point face. This provides high dielectric strength and welding resistance while maintaining high conductivity.

When oxygen contained in the electric contact member is kept at 2500 ppm or less, gas discharge is reduced at the time of current breaking, and possible failure of current breaking due to arc production sustained by gas can be prevented.

When the tensile strength in the direction perpendicular to the contact point face is 150 MPa or less, and the tensile strength in the direction parallel to the contact point face is 150 MPa or more, it is easier to separate and open the contact when the electrode is welded by arc heating at the time of current breaking, with the result that welding resistance is improved.

The specific resistance of the electric contact member is preferred to be 5.5 $\mu\Omega$.cm or less. There is no anisotropy since electric characteristics depend on the amount of the highly conductive metal contained. This specific resistance ensures excellent breaking performances.

In the production of an electric contact member, it is preferred that a powder mixture consisting of fire proof metal powder and highly conductive metal powder be pressure-molded at a pressure of 120 to 500 MPa to create a molded product; and this molded product be sintered under vacuum or in inert atmosphere at the melting point equal to or less than that of the highly conductive metal powder. If the molding pressure is smaller than 120 MPa, molding density will be smaller and the molded product will be susceptible to damage. If it is greater than 500 MPa, the service life of the die and productivity are reduced. When the molded product is sintered under vacuum or in inert atmosphere, sound sintered structure and adequate amount of contained gas are ensured. The fire proof metal powder having the form of a flat plate tends to be oriented parallel to the pressurized surface in the molding process, it is preferred that the surface parallel to the pressurized surface be used as the flat surface. This ensures the characteristics intended in the present invention.

Further, the produced electric contact member is made compact by a pressure of 400 MPa or more applied in the same direction as that of the molding process. This will lead to the stability of the electrode performance, and will also reinforce the orientation of fire proof metal powder having the form of a flat plate, with the result that the characteristics intended in the present invention are improved.

In the production of an electric contact member according to the present invention, a continuous plate- or rod-formed molded product can be created by extrusion and compression molding of a powder mixture consisting of fire proof metal powder and highly conductive metal powder; and the molded product can be sintered continuously under vacuum or in inert atmosphere at the melting point equal to or less than that of the highly conductive metal powder. This method allows an electric contact member to be produced at a low production cost with high productivity. Since the fire proof metal powder having the form of a flat plate tends to oriented in parallel to the direction of extrusion, it is preferred that the surface parallel to the direction of extrusion be used as a contact point face. This ensures the characteristics intended in the present invention.

The electric contact member produced can be made more compact by further continuous rolling with the result that electrode performances are made more stable. This rolling operation can be performed at the normal temperature. Cracks and other material defects can be prevented by warm rolling operation performed at the melting point equal to or less than that of the highly conductive metal. Orientation of fire proof metal powder having the form of a flat plate can be reinforced by rolling, with the result that the characteristics intended in the present invention are improved.

An electrode of a desired form can be obtained effectively in a short time by punching the produced electric contact member perpendicularly to the direction of extrusion. The particle size of the highly conductive metal powder as a material of the above-mentioned electric contact member is preferred to be 80 $\mu$m or less. If the particle size of the highly conductive metal powder is greater, it will be difficult to oriented the fire proof metal powder in the process of formation of the powder mixture, and to get the characteristics intended in the present invention.

In the vacuum valve according to the present invention, the value y obtained by multiplying the rated voltage (kV) by breaking current effective value (kA) is preferred to be not more than the value obtained by the following equation (1) and not less than the value obtained by the following equation (2), based on the outer diameter x (mm) of the vacuum container:

$$y=11.25x-525 \quad (1)$$

$$y=5.35x-242 \quad (2)$$

In the electric contact according to the present invention, the diameter y (mm) is preferred to be not more than the value obtained by the following equation (3) and not less than the value obtained by the following equation (4), based on the value x (kVA$\times 10^3$) obtained by multiplying the rated voltage (kV) by breaking current effective value (kA):

$$y=0.15x+22 \quad (3)$$

$$y=0.077x+20 \quad (4)$$

In the vacuum valve according to the present invention, the diameter y (mm) of the vacuum container is preferred to be within the range from the value obtained by the following equation (5) or less to the value obtained by the following equation (6) or more, based on the diameter x (mm) of the electric contact:

$$y=1.26x+30 \quad (5)$$

$$y=1.26x+10 \quad (6)$$

The electric contact member according to the present invention has the texture wherein fire proof metal powder having the form of a flat plate is oriented parallel to the contact point face in the matrix comprising a highly conductive metal. This increases the area occupied by the fire proof metal powder and improves dielectric strength and welding resistance without reducing the breaking performance.

The production method according to the present invention allows effective mass production of the electric contact member having the above-mentioned material texture, thereby reducing the production costs.

DESCRIPTION OF THE PREFERRED EMBODIMENTS

Figure 1A:
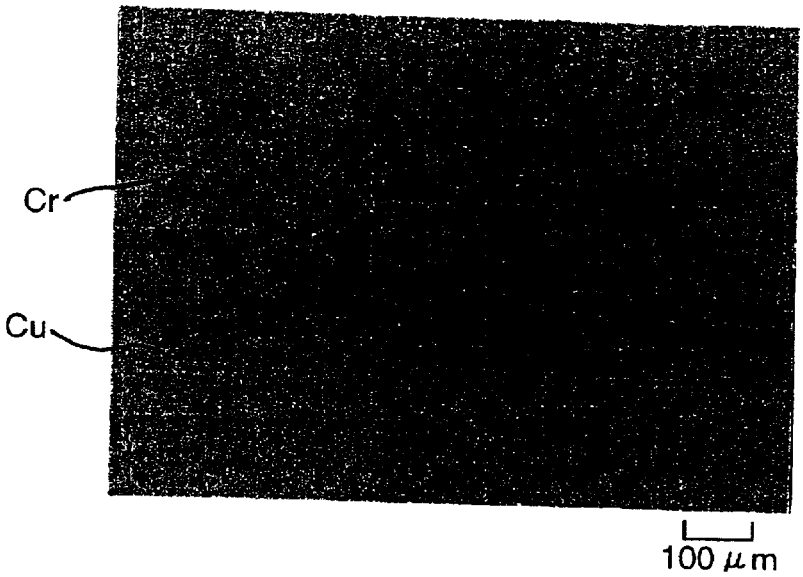
FIG. 1 is a photo representing an example of the texture of the electric contact member as a first embodiment of the present invention.

The following describes the present invention specifically with reference to embodiments:

[First Embodiment]

As the first embodiment of the present invention, the present inventors have produced an electric contact member with a composition of 25 Cr—75 Cu, using Cr as a fire proof metal Cu as a highly conductive metal. The following describes how to manufacture this electric contact member:

The prevent inventors produced flat Cr powder by flattening the Cr powder as fire proof metal through compression of a roller preset to a specified dimension of clearance, wherein the maximum length of the flat surface divided by the minimum dimension of the surface perpendicular thereto hereinafter referred to as "aspect ratio") was 3, 10, 30 and 40 (Reference Example). For another Reference Example, Cr powder as unprocessed material was used with the aspect ratio of 1. The Cr powder used contained 1100 ppm of oxygen, 800 ppm of aluminum and 440 ppm of silicon.

Cu powder having a particle size of 80 μm or less, and 80 μm or more was used as highly conductive metal. Ten types of the electric contact members shown in Table 1 were created by combination of the above-mentioned flat Cr powder and Cu powder.

TABLE 1

| | | | | Percentage of Cr included in the following range of angles (wt %) | | Percentage of area occupied by Cr on each surface (%) | |
|---|---|---|---|---|---|---|---|
| Sample number | Composition (wt %) | Cr powder, aspect ratio | Cu powder, particle size (μm) | ±40 deg. with respect to contact point face | ±20 deg. with respect to contact point face | Contact point face | Cross section perpendicular to contact point face |
| A | 25Cr—Cu | 1 (used as material) | 80 or less | — | — | 29.1 | 29.4 |
| B | | 3 | | 94.4 | 77.9 | 33.8 | 22.9 |
| C | | 10 | | 95.5 | 78.6 | 38.5 | 20.5 |
| D | | 30 | | 96.3 | 79.8 | 48.1 | 17.7 |
| E | | 40 | | 98.5 | 80.9 | 55.9 | 16.1 |
| F | | 1 (used as material) | 80 or more | — | — | 28.7 | 29.3 |
| G | | 3 | | 55.1 | 31.2 | 31.2 | 29.1 |
| H | | 10 | | 68.4 | 49.8 | 34.3 | 27.8 |
| I | | 30 | | 81.7 | 60.3 | 39.9 | 26.7 |
| J | | 40 | | 88.0 | 67.6 | 40.9 | 24.4 |

Flat Cr powder and Cu powder were mixed at the rate of 25 to 75 in terms of weight percentage in a V-shaped mixer. Then a die having a diameter of 60 mm was filed with the powder mixture. A pressure of 250 MPa was applied to a circular surface by the hydraulic press to provide pressure molding. The molded product had a diameter of 600 mm and a thickness of 12 mm with a relative density of 73%. This was heated at 1050 degrees Celsius for 120 minutes under vacuum of $6.7\times10^{-3}$ Pa or less to produce electric contact members given in Table 1. After sintering and heating, relative density was 97 to 98 percent in all cases.

FIG. 1 shows an example of the texture of the produced electric contact members. It is a photo representing the texture (where the aspect powder of Cr powder is 10 and Cu power particle size of 80 $\mu$m or less). An optical microscope was used to observe the circular surface of the electric contact member (hereinafter referred to as "contact point face") and cross section perpendicular thereto.

In FIG. 1, (a) shows the texture of the surface parallel to the contact point face, and (b) represents the texture of the cross section perpendicular to the contact point face. It has been confirmed that the flat surface of Cr particle on the contact point face of (a) occupies a relatively large area, and the flat surface of Cr particle is oriented almost parallel to the contact point face on the cross section perpendicular to the contact point face in (b). This has demonstrated that Cr powder having the form of a flat plate tends to be oriented perpendicular to the direction where pressure is applied, and the material texture intended in the present invention can be obtained by using the contact point face in parallel with the pressure surface.

A optical microscope was used to observe the contact point faces of ten types of the electric contact members produced and cross sections perpendicular thereto to find the percentage of the Cr particle oriented with respect to contact point face within the range from ±40 and ±20 degrees. For the percentage of Cr particle, image processing was used to find out the area of Cr within each range of angle, and calculation was made to get a weight percentage for all the included Cr.

Table 1 shows the percentage of Cr within each range of angle. It has been confirmed that, when the Cu particle size is 80 Rm or less, 90 wt % or more is oriented within the range from +40 to −40 degrees and 75 wt % or more is oriented within the range from +20 to −20 degrees if the aspect ratio of the Cr powder is 3 to 40.

It has been confirmed by contrast that, when the particle size of Cu is 80 $\mu$m or more, Cr within the range from +40 to −40 degrees is less than 90 wt % even when the aspect ratio of Cr powder is 40, and Cr within the range from +20 to −20 degrees is below 75 wt %. This discussion proves that the particle size of Cu is preferred to be 80 $\mu$m or less in order to ensure the flat Cr powder is oriented in a desired direction.

Table 1 also shows the result of image processing to get the percentage of the area occupied by Cr (area occupancy rate) on the contact point face of the electric contact member and cross section perpendicular thereto. When the particle diameter of Cu is 80 $\mu$m or less, the area occupancy rate is 30% or more on the contact point face and 14 to 25% on the cross section perpendicular thereto, if the aspect ratio of Cr powder is 3 to 40. However, when the aspect ratio of Cr powder is 40 (test number E), the area occupancy rate of Cr is 50% or more on the contact point face. If used as an electrode, the contact resistance with the counterpart electrode will increase, and current carrying capacity will be reduced; this is not preferred. Thus, the preferred aspect ratio of Cr powder is within the range from 3 to 30.

It has been confirmed that the trend discussed above also applies to the cases where fire proof metal is made up of one of W, Mo, Ta, Nb, Be, Hf, Ir, Pt, Zr, Ti, Te, Si, Rh and Ru (other than Cr), a mixture comprising two or more of them or a compound thereof, and the highly conductive metal is Ag, Au or alloy mainly consisting of them other than Cu.

[Second Embodiment]

In another embodiment of the present invention, five types of electric contact members were produced wherein the fire proof metal of Cr and highly conductive metal of Cu were used, and the amount of Cr was changed within the range from 10 to 45 wt %. The aspect ratio of of Cr powder was 15 and the particle size of Cu powder was 80 $\mu$m or less. These electric contact members were produced in the same method as the first embodiment. After sintering and heating, these electric contact members exhibited a relative density of 97 to 98%.

Table 2 shows the composition of the produced electric contact members, the percentage of Cr particles oriented within ±40 degrees and ±20 degrees with respect to the contact point face, and the area occupancy rate of Cr on the contact point face and cross section perpendicular thereto.

TABLE 2

| Sample number | Composition (wt %) | Cr powder, aspect ratio | Cu powder, particle size ($\mu$m) | Percentage of Cr included in the following range of angles (wt %) | | Percentage of area occupied by Cr on each surface (%) | |
|---|---|---|---|---|---|---|---|
| | | | | ±40 deg. with respect to contact point face | ±20 deg. with respect to contact point face | Contact point face | Cross section perpendicular to contact point face |
| K | 10Cr—Cu | 15 | 80 or less | 93.1 | 77.4 | 28.4 | 12.9 |
| L | 15Cr—Cu | | | 95.4 | 78.1 | 31.2 | 14.4 |
| M | 25Cr—Cu | | | 95.9 | 78.3 | 39.1 | 21.0 |
| N | 40Cr—Cu | | | 96.0 | 79.4 | 48.5 | 24.6 |
| O | 45Cr—Cu | | | 96.8 | 78.9 | 51.2 | 26.0 |

It has been confirmed that, in any of the compositions, 90 wt % or more of Cr is oriented within the range from +40 to −40 degrees and 75 wt % or more is oriented within the range from +20 to −20 degrees. For the composition of 10 Cr—Cu (sample K), however, the area occupancy rate of Cr is 30% or less on the contact point surface, and 14% or less on the cross section perpendicular thereto. In this case, the object of the present invention to ensure compatibility between breaking performance and high dielectric strength cannot be achieved. For the composition of 45 Cr—Cu (sample O), the area occupancy rate is 50% on the contact point face and current carrying capacity is reduced; this is not preferred. Thus, it has been confirmed that appropriate weight percentage of Cr is 15 to 40 and that of Cu is 60 to 85.

It has been confirmed that the trend discussed above also applies to the cases where fire proof metal is made up of one of W, Mo, Ta, Nb, Be, Hf, Ir, Pt, Zr, Ti, Te, Si, Rh and Ru (other than Cr), a mixture comprising two or more of them or a compound thereof, and the highly conductive metal is Ag, Au or alloy mainly consisting of them other than Cu.

[Third Embodiment]

In the third embodiment, tensile strength and specific resistance in the directions perpendicular to the contact point face and parallel to it was measured regarding the sample numbers A to D and L to N of electric contact members produced in the first and second embodiments.

Table 3 shows the result of measurement.

TABLE 3

| | | | Tensile strength (MPa) | | Specific resistance ($\mu\Omega \cdot$ cm) | |
|---|---|---|---|---|---|---|
| Sample number | Composition (wt %) | Cr powder, aspect ratio | Perpendicular to contact point face | Parallel to contact point face | Perpendicular to contact point face | Parallel to contact point face |
| A | 25Cr—Cu | 1 | 144 | 149 | 4.09 | 4.03 |
| B | | 3 | 141 | 151 | 4.08 | 4.06 |
| C | | 10 | 130 | 158 | 4.12 | 4.04 |
| D | | 30 | 119 | 166 | 4.14 | 4.07 |
| L | 15Cr—Cu | 15 | 129 | 157 | 2.68 | 2.70 |
| M | 25Cr—Cu | | 126 | 161 | 4.10 | 4.08 |
| N | 40Cr—Cu | | 144 | 168 | 5.29 | 5.19 |

Compared to the sample number A using Cr as unprocessed material powder, the tensile strength in the direction perpendicular to the contact point face was 150 MPa or less, while the tensile strength parallel to the contact point face was 150 MPa or more in all cases. Since the strength perpendicular to the contact point surface is small, separation and fracture are likely to occur when welded with the counterpart electrode, with the result that welding resistance is improved.

There is no remarkable anisotropy to specific resistance. Since electric characteristics are almost dominated by composition, there is no directivity in conductivity even if Cr powder is flat in form, and this makes it possible to maintain breaking performances to the same level as that of the previous texture.

It has been confirmed from the above discussion that the contact point face according to the present invention is subjected to easier separation in the direction perpendicular to the contact point face, and there is no anisotropy to conductivity.

[Fourth Embodiment]

In a fourth embodiment according to the present invention, an electrode for application to vacuum valve was produced using the sample numbers A to E and K to O of electric contact members produced in the first and second embodiments.

Figure 2:
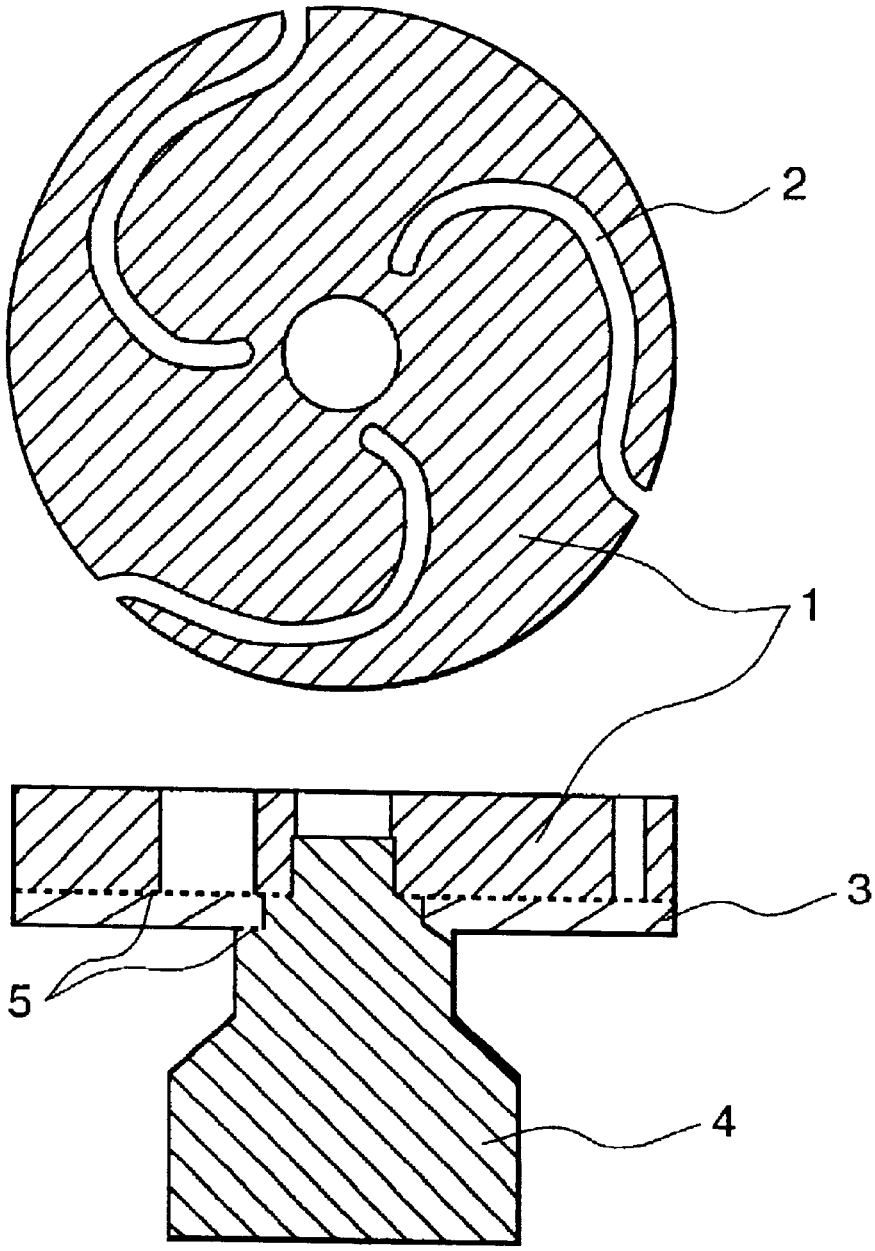
FIG. 2 shows the structure of the electrode as a fourth embodiment of the present invention.

FIG. 2 shows the structure of the electrode produced. In FIG. 2, 1 denotes a electric contact, 2 a spiral groove giving a drive force to arc not to allow it to stand still, 3 a reinforcing plate made of stainless steel, 4 an electrode rod and 5 a brazing filler material. The following describes how to produce the electrode: The electric contact member produced in the first and second embodiments were formed into a desired form by machining, thereby getting an electric contact 1. The electrode rod 4 was made of anoxic copper and a reinforcing plate 3 was made of SUS304 by machining in advance. The center holes of electric contact 1 and reinforcing plate 3 and the concave of the electrode rod 4 are fitted together through brazing filler material 5, and a brazing filler material 5 is also placed between the electric contact 1 and reinforcing plate. This was heated at 980 degrees Celsius for eight minutes under vacuum of $8.2\times10^{-4}$ Pa or less to produce an electrode shown in FIG. 8. This electrode is used for the vacuum value for a rated voltage of 7.2 kV, rated current of 600A and rated breaking current of 200 kA.

[Fifth Embodiment]

Figure 1B:
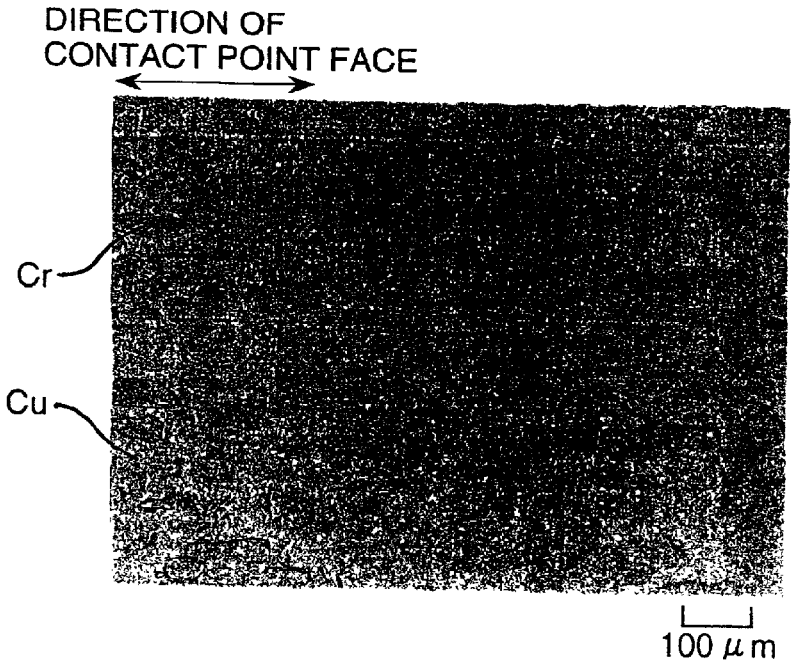
Figure 3:
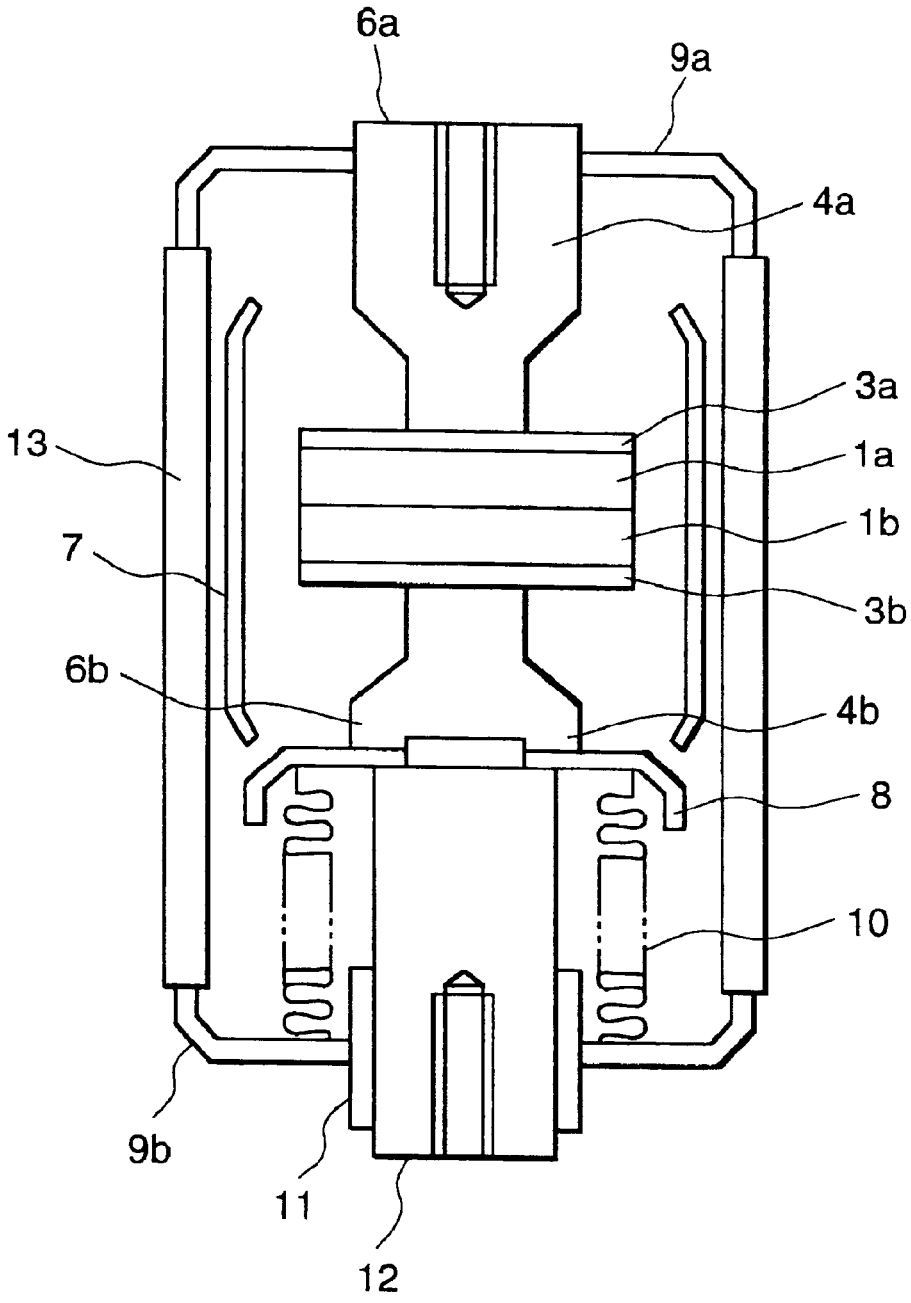
FIG. 3 shows the structure of the vacuum valve as a fifty embodiment of the present invention.

The present inventors manufactured a vacuum valve equipped with the electrode produced in the embodiment. The vacuum valve is specified to have a rated voltage of 7.2 kV, a rated current of 600A and a rated breaking current of 20 kA. FIG. 3 shows the structure of a vacuum valve according to the present invention. In FIG. 3, 1*a* and 1*b* denote electric contacts on the fixed and movable sides, respectively. 3*a* and 3*b* show reinforcing plates, and 4*a* and 4*b* indicate electrode rods on the fixing and movable sides, which constitute an electrode 6*a* on the fixed side and an electrode 6*b* on the movable side. The electrode 6*b* on the movable side is bonded to a holder 12 on the movable side through a shield 8 on the movable side to prevent metal vapor from being sprayed away at the time of breaking. They are brazed and sealed to a high degree of vacuum by an end plate 9*a* on the fixed side, end plate 9*b* on the movable side and insulation sleeve 13, and are connected to the outside by the threaded portions of the electrode 6*a* on the fixed side and holder 12 on the movable side. Inside the insulation sleeve 13, there is a shield 7 to prevent metal vapor from being sprayed away at the time of breaking. A guide 11 to support the sliding portion is installed between an end plate 9*b* on the movable side and holder 12 on the movable side. A bellows 10 is installed between the shield 8 on the movable side and end plate 9*b* on the movable side, and the holder 12 on the movable side is moved in the vertical direction with the interior of the vacuum valve kept in a vacuum state, thereby allowing the electrode 6*a* on the fixed side and electrode 6*b* on the movable side to be opened or closed. In the present embodiment, the vacuum valve shown in FIG. 3 was produced using the electrode having a structure shown in FIG. 2 produced in the fourth embodiment as electrode 6*a* on the fixed side and electrode 6*b* on the movable side. In this way, the vacuum valve shown in FIG. 3 was produced.

[Sixth Embodiment]

Table 4 shows the result of various performance tests conducted on the vacuum valve built in the vacuum circuit breaker, wherein the vacuum valve was produced in the fifth embodiment.

TABLE 4

| Sample number | Composition | Cr powder, aspect ratio | Breaking performance | Dielectric strength | Welding resistance | Remarks |
|---|---|---|---|---|---|---|
| A | 25Cr—Cu | 1 | 1.0 | 1.0 | 1.0 | Prior art texture (reference) |
| B | | 3 | 1.0 | 1.2 | 1.1 | |
| C | | 10 | 1.0 | 1.5 | 1.3 | |
| D | | 30 | 1.0 | 1.9 | 1.6 | Large current carrying resistance |
| E | | 40 | 1.0 | 2.1 | 1.7 | Insufficient dielectric strength |
| K | 10Cr—Cu | 15 | 0.8 | 0.7 | 1.0 | |
| L | 15Cr—Cu | | 1.1 | 1.0 | 1.1 | |
| M | 25Cr—Cu | | 1.0 | 1.6 | 1.3 | |
| N | 40Cr—Cu | | 0.9 | 1.9 | 1.5 | |
| O | 45Cr—Cu | | 0.7 | 2.0 | 1.6 | Insufficient breaking performance |

Table 4 shows the comparison of performances where "1" represents the value of sample A having the texture consisting of the material according to the prior art where Cr as unprocessed material is used.

Samples A to E show no change in the breaking performance despite changes in the aspect ratio of Cr powder. This is because there is almost no change in specific resistance, as shown in Table 3. In the meantime, dielectric strength is increased with the aspect ratio. This is due to increase of the area occupancy rate of Cr on the contact point face, as shown in Table 1. Further, welding performance is also increased with the aspect ratio. This is because there is a big area occupancy rate of Cr and tensile strength perpendicular to the contact point face is reduced, as shown in Table 3, with the result that separation and dissociation are likely to occur. However, the sample E where the aspect ratio of Cr powder is 40 has a large percentage of the area occupied by Cr on the contact point face, accompanied by increased contact resistance between electrodes and current carrying resistance. This is not preferred. Thus, it has been demonstrated that, when the aspect ratio of Cr powder is within the range from 3 to 30, dielectric strength and welding resistance can be improved while the present breaking performance is maintained.

Of samples K to O, sample N has a breaking performance of 0.9 which is smaller than sample A having the texture according to the prior art, but can be applied to the vacuum circuit breaker for rated breaking current of 20 kA. However, sample 0 had an insufficient breaking performance and could not be applied to the vacuum circuit breaker for rated breaking current of 20 kA. Further, decrease in the amount of Cr is accompanied by decrease of dielectric strength. The resulting re-arcing causes deterioration of breaking performance; thus, it was difficult to apply sample K to the vacuum circuit breaker for rated breaking current of 7.2 kA. Accordingly, the adequate amount of Cr is 15 to 40 wt %.

The electric contact member produced in the first and second embodiments was again put into the die and pressures of 400, 600 and 800 MPa were applied to it. This electric contact member was used to evaluate the performance of the electrode produced according to the same method as the fourth embodiment. The electric contact member under any of the above-mentioned pressures exhibited a relative density of 98.5% or more. Then the same trend as the above result was observed. It has been shown that breaking performance tended to reach a further stability. This is because the material was made more compact by application of pressure again after sintering, with the result that the amount of internal defect or gas was decreased.

The above tests have demonstrated that the electric contact member according to the present invention is effective in ensuring compatibility of breaking performance, high dielectric strength and welding resistance.

[Seventh Embodiment]

Figure 4:
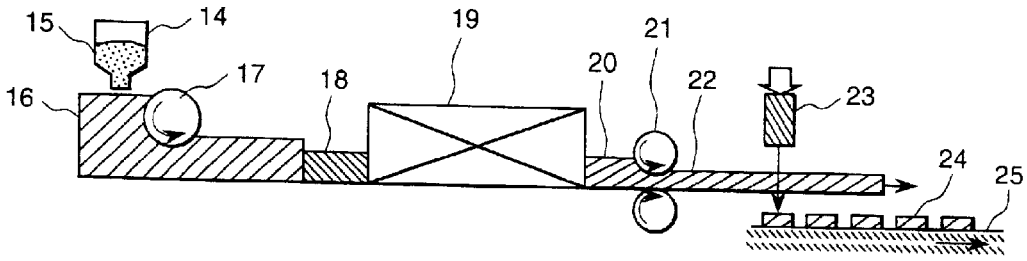
FIG. 4 shows the production method and equipment as a seventh embodiment of the present invention.

In another production method according to the present invention, the present authors produced the same electric contact member as those in the first and second embodiments. FIG. 4 is a schematic view representing the production method and equipment according to the present embodiment. In FIG. 4, numeral 14 denotes a vessel for containing a material powder mixture 15, and 16 shows a molding machine for continuous extrusion and molding of the material powder mixture 15 charged from the vessel 14. Numeral 17 denotes a roller for molding the material powder mixture 15 and feeding it out while rotating, 18 a continuous molded product of a plate formed, 19 a tunnel furnace for continuous heating and sintering of the continuous molded product 18 in inert atmosphere, 20 a continuous sintered product obtained by heating and sintering, 21 a for rolling the continuous sintered product 20 to make it compact, 22 a rolled electric contact member, 23 a die for punching an electric contact 24 of a desired form from electric contact member 22, and 25 a belt for continuous transfer of electric contact 24 produced by punching.

The molding pressure, sintering temperature and post-sintering rolling pressure according to the present embodiment were set to almost the same values as those in the first and second embodiments.

The present inventors have examined the texture, tensile strength, specific resistance and other properties of the electric contact member produced according to the present embodiment, and the results were almost the same those of the electric contact members produced in the first and second embodiments.

Thus, it has been proven that the present manufacturing method allows a great number of electric contact members to be manufactured on a continuous basis at a low production cost with high productivity, and ensures compatibility of breaking performance, high dielectric strength and welding resistance, thereby meeting the object of the present invention.

[Eighth Embodiment]

Table 5 shows the specifications of variously rated vacuum valves produced using the members of sample B for electric contacts 1*a* and 1*b*.

TABLE 5

| Item | | No. 1 | 2 | 3 | 4 | 5 | 6 | 7 | 8 | 9 |
|---|---|---|---|---|---|---|---|---|---|---|
| Rating | Current (A) | 600 | 500 | 1200 | 2000 | 3000 | 3000 | 600 | 1200 | 2000 |
| | Voltage (V) | 7.2 | 7.2 | 7.2 | 7.2 | 7.2 | 15 | 12 | 7.2 | 24 |
| | Breaking current effective value (KA) | 12.5 | 20 | 31.5 | 40 | 63 | 50 | 16 | 31.5 | 25 |
| | Breaking voltage/current effective value ($\times 10^3$ KVA) | 90 | 142 | 225.8 | 288 | 453.5 | 750 | 192 | 226.8 | 500 |
| Vacuum container | Outer diameter (mm) | 62 | 72 | 90 | 100 | 130 | 130 | 72 | 90 | 100 |
| | Length (mm) | 100 | 100 | 100 | 130 | 215 | 215 | 130 | 170 | 215 |
| Electric contact | Diameter (mm) | 32 | 42 | 57 | 65 | 86 | 65 | 39 | 57 | 50 |
| | Thickness (mm) | 8 | 9 | 10 | 15 | 17 | 17 | 9 | 10 | 10 |

Figure 5:
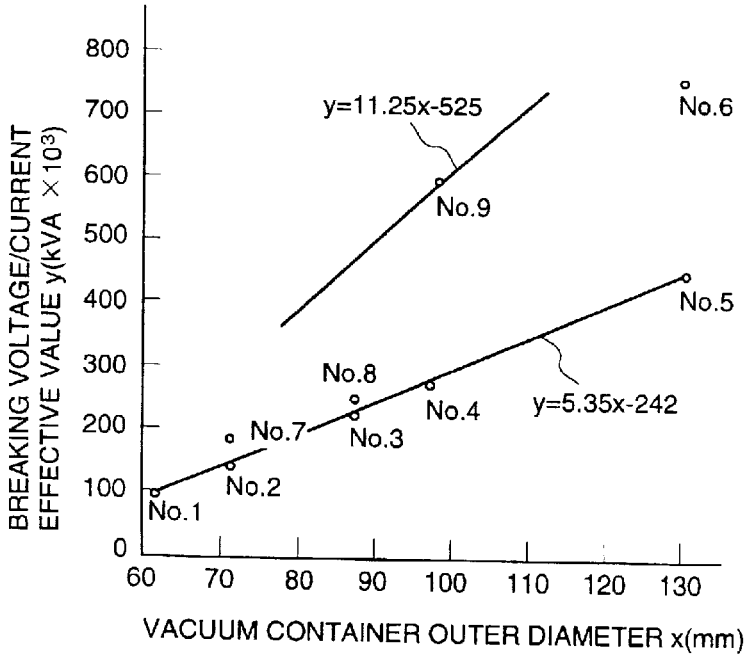
FIG. 5 shows the relationship between the breaking voltage/current effective value and outer diameter of the vacuum valve as a eighth embodiment of the present invention.

FIG. 5 is a diagram representing the relationship between breaking voltage/current effective value (y) and vacuum container outer diameter (x). Breaking voltage/current effective value is obtained by multiplying the breaking voltage (kV) by breaking current effective value (kA). The relationship of the vacuum container outer diameter (x) with respect to breaking voltage/current effective value is preferred to be determined so that breaking voltage/current effective value (y) will come between the values obtained from 11.25x−525 and 5.35x−242, as shown in FIG. 5.

Figure 6:
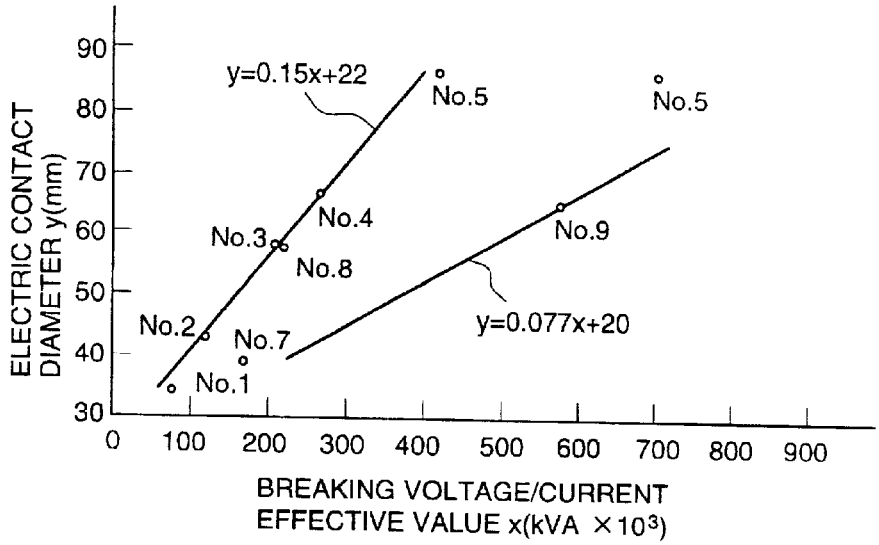
FIG. 6 shows the relationship between the electric contact diameter and breaking voltage/current effective value of the vacuum valve as a eighth embodiment of the present invention.

FIG. 6 is a diagram representing the relationship between electric contact diameter (y) and breaking voltage/current effective value (x). The relationship of the electric contact diameter (y) with respect to breaking voltage/current effective value (x) is preferred to be determined so that it will come between the values obtained from 0.15x+22 and 0.077x+20.

Figure 7:
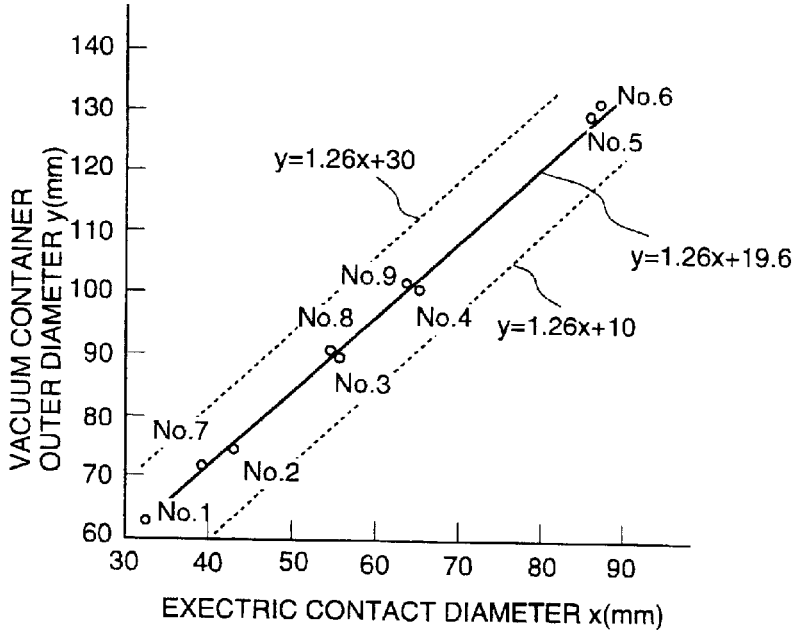
FIG. 7 shows the relationship between the vacuum container outer diameter and electric contact diameter of the vacuum valve as a eighth embodiment of the present invention.

FIG. 7 is a diagram representing the relationship between vacuum container outer diameter (y) and electric contact diameter (x). The vacuum container outer diameter (y) is preferred to be determined so that it will come between the values obtained from 1.26x+30 and 1.26x+10. In the present embodiment, it is set approximately to the value obtained from y=1.26x+19.6.

What is claimed is:

1. A vacuum valve, comprising:

a vacuum container; and first and second electrodes provided on fixed and movable sides, respectively, in the vacuum container;

wherein each of said first and second electrodes includes an electric contact member produced by dispersing fireproof flat metal powder particles into a matrix comprising a highly conductive metal, followed by pressure molding the matrix and then sintering the pressure-molded matrix;

wherein the electric contact member comprises a sintered body that is sintered after pressure molding; and wherein the flat surfaces of said fireproof flat metal powder particles are oriented in one direction, and said electric contact member has a contact point face surface that is parallel to the flat surface of said fireproof flat metal powder particles.

2. A vacuum valve according to claim 1, further comprising:

first and second electrode rods connected to the first and second electrodes, respectively;

wherein said vacuum container is cylindrical; and a value y obtained by multiplying the rated voltage (kV) by breaking current effective value (kA) is not more than the value obtained by the following equation (1) and not less than the value obtained by the following equation (2), based on the outer diameter x (mm) of said vacuum container:

$$y=11.25x-525 \quad (1)$$

$$y=5.35x-242 \quad (2).$$

3. A vacuum valve according to claim 1, further comprising:

first and second electrode rods connected to the first and second electrodes, respectively;

wherein the diameter y (mm) of each said electric contact is not more than the value obtained by the following equation (3) and not less than the value obtained by the following equation (4), based on the value x (kVA$\times 10^3$) obtained by multiplying the rated voltage (kV) by breaking current effective value (kA):

$$y=0.15x+22 \quad (3)$$

$$y=0.077x+20 \quad (4).$$

4. A vacuum valve according to claim 1, further comprising:

first and second electrode rods connected to the first and second electrodes, respectively;

wherein said vacuum container is cylindrical; and the outer diameter y (mm) of said vacuum container is within the range from the value obtained by the following equation (5) or less to the value obtained by the following equation (6) or more, based on the diameter x (mm) of said electric contact:

$$y=1.26x+30 \quad (5)$$

$$y=1.26x+10 \quad (6).$$

5. A vacuum valve according to claim 1, wherein said fireproof flat metal powder particles each have a characteristic in which maximum flat surface length of said particles divided by minimum dimension of a surface perpendicular thereto of said particles is within the range from 3 to 30.

6. A vacuum valve according to claim 1, wherein 90 wt % or more of the fireproof flat metal powder particles have a flat surface oriented with respect to the contact point face within the range from +40 to −40 degrees.

7. A vacuum valve according to claim 1, wherein 75 wt % or more of the fireproof flat metal powder particles have a flat surface oriented with respect to the contact point face within the range from +20 to −20 degrees.

8. A vacuum valve according to claim 1, wherein the fireproof flat metal powder particles comprise one of Cr, W, Mo, Ta, Nb, Be, Hf, Ir, Pt, Zr, Ti, Te, Si, Rh and Ru, a mixture comprising two or more of them, or a compound thereof; and the highly conductive metal comprises Cu, Ag, Au or an alloy mainly consisting of them.

9. A vacuum valve according to claim 1, wherein the fireproof flat metal powder particles contain 50 to 2000 ppm of oxygen, 50 to 3000 ppm of aluminum and 100 to 2500 ppm of silicon.

10. A vacuum valve according to claim 1, wherein the vacuum valve is 15 to 40 wt % of the fireproof flat metal powder particles, and 60 to 85 wt % of the highly conductive metal.

11. A vacuum valve according to claim 1, wherein the percentage of the area of the contact point face which is occupied by the fireproof flat metal powder particles is 30 to 50%, and the percentage of the area of the surface perpendicular to the contact point face which is occupied by the fireproof flat metal powder particles is 14 to 25%.

12. A vacuum valve according to claim 1, wherein the fireproof flat metal powder particles contain 2500 ppm or less of oxygen.

13. A vacuum valve according to claim 1, wherein tensile strength of said electric contact member in the direction perpendicular to the contact point face is 150 MPa or less.

14. A vacuum valve according to claim 1, wherein the specific resistance of said electric contact member is 5.5 $\mu\Omega$.cm or less.

* * * * *